US005944581A

United States Patent [19]

Goenka

[11] Patent Number: 5,944,581

[45] Date of Patent: Aug. 31, 1999

[54] $CO_2$ CLEANING SYSTEM AND METHOD

[75] Inventor: Lakhi Nandlal Goenka, Ann Arbor, Mich.

[73] Assignee: Ford Motor Company, Dearborn, Mich.

[21] Appl. No.: 09/114,569

[22] Filed: Jul. 13, 1998

[51] Int. Cl.[6] ..... B24B 1/00; B24C 1/00

[52] U.S. Cl. ..... 451/39; 451/40

[58] Field of Search ..... 451/28, 33, 36, 451/39, 40, 41, 53, 75, 102, 87, 91, 103, 7; 134/7, 13, 24, 6, 8; 83/16, 53, 169, 177

[56] References Cited

U.S. PATENT DOCUMENTS

| | | |
|---|---|---|
| 4,962,891 | 10/1990 | Layden . |
| 5,405,283 | 4/1995 | Goenka . |
| 5,514,024 | 5/1996 | Goenka . |
| 5,545,073 | 8/1996 | Kneisel et al. . |
| 5,616,067 | 4/1997 | Goenka . |
| 5,651,834 | 7/1997 | Jon et al. . |

*Primary Examiner*—David A. Scherbel
*Assistant Examiner*—Derris Holt Banks
*Attorney, Agent, or Firm*—Leslie C. Hodges; Roger L. May

[57] ABSTRACT

An apparatus is provided for cleaning a workpiece with solid $CO_2$ particles. A flow channel member includes a flow channel therein having an exhaust nozzle at a distal end thereof. A source of pressurized air is provided in selective fluid communication with the flow channel. A phase separator includes first and second portions, with the first portion being in selective fluid communication with the flow channel. A source of liquid $CO_2$ is provided in selective fluid communication with the phase separator. A liquid flow line includes first and second ends, with the first end being in fluid communication with the second portion of the phase separator, and the second end includes an injector nozzle positioned with the flow channel. The phase separator is operative to separate $CO_2$ vapor from the liquid $CO_2$ such that the vapor travels to the first portion for selective communication with the flow channel and the liquid remains in the second portion for injection through the injector nozzle.

9 Claims, 1 Drawing Sheet

$CO_2$ CLEANING SYSTEM AND METHOD

TECHNICAL FIELD

The present invention relates to an apparatus and method for creating abrasive $CO_2$ snow and for directing the snow at high speeds onto an area of contaminants to be removed from a workpiece, and more particularly to a method of eliminating pulsing during the $CO_2$ spraying by eliminating vapor from the liquid $CO_2$ prior to injection into an air flow channel.

BACKGROUND OF THE INVENTION

The use of liquid carbon dioxide for producing $CO_2$ snow and subsequently accelerating it to high speed for cleaning particles from a substrate is taught by Layden in U.S. Pat. No. 4,962,891. A saturated $CO_2$ liquid having an entropy below 135 BTU per pound is passed through a nozzle for creating, through adiabatic expansion, a mix of gas and $CO_2$ snow. A series of chambers and plates are used to enhance the formation of larger droplets of liquid $CO_2$ that are then converted through adiabatic expansion into solid $CO_2$ snow.

My U.S. Pat. No. 5,405,283 was directed to an apparatus for creating $CO_2$ snow which utilizes inexpensive components and readily available low pressure shop air for improving the efficiency of creating $CO_2$ snow and for improving the coagulation of the $CO_2$ snow into larger $CO_2$ particles. In this patent, a nozzle is provided for receiving and expelling liquid $CO_2$ through an orifice sized for converting the liquid into $CO_2$ snow. A body, defining a cavity therein, is coupled to the nozzle such that the snow is injected into the cavity. An exhaust nozzle is coupled to the body and the cavity therein for directing the pressurized $CO_2$ snow toward the workpiece to be cleaned. In one variation, a mixing device is optionally coupled to the nozzle for receiving and mixing pressurized shop air and liquid nitrogen, and then directing the cooled shop air into the cavity for cooling the area adjacent to the nozzle. In this manner, the pre-cooled shop air enhances the efficiency of the conversion of liquid $CO_2$ into $CO_2$ snow particles by cooling and pressurizing the area adjacent to the orifices in the nozzle within the cavity.

A problem with this design is that the system sometimes experiences pulsing because vapor is trapped within the liquid $CO_2$, which causes undesirable discontinuities in the formation of $CO_2$ snow.

DISCLOSURE OF INVENTION

The present invention overcomes the above-referenced shortcomings of prior art $CO_2$ cleaning systems by providing a $CO_2$ cleaning system which includes a phase separator operative to separate $CO_2$ vapor from the liquid $CO_2$ to avoid pulsing. The system also includes a rapid purge valve for purging vapor from the liquid $CO_2$ line for quick start up and shut down of the system.

More specifically, the present invention provides an apparatus for cleaning a workpiece with solid $CO_2$ particles, including a channel member forming a flow channel having an exhaust nozzle at a distal end thereof, and a source of pressurized air in selective communication with the flow channel. A phase separator has first and second portions, with the first portion being in selective fluid communication with the flow channel. A source of liquid $CO_2$ is provided in selective fluid communication with the phase separator. A liquid flow line includes first and second ends, the first end being in fluid communication with the second portion of the phase separator, and the second end having an injector nozzle positioned within the flow channel. The phase separator is operative to separate $CO_2$ vapor from the liquid $CO_2$ such that the vapor travels to the first portion for discharge into the flow channel and the liquid remains in the second portion for injection through the injector nozzle. Preferably, a purge line is provided in fluid communication between the liquid flow line and the flow channel, and includes a purge valve therein for selectively purging $CO_2$ vapor from the liquid line for quick start up of the apparatus.

Another aspect of the invention provides a method of cleaning a workpiece with solid $CO_2$ particles, including the steps of: a) forcing air through a flow channel having an exhaust nozzle at a distal end thereof; b) introducing liquid $CO_2$ into a phase separator to separate $CO_2$ vapor from the liquid $CO_2$; c) introducing the separated $CO_2$ vapor into the flow channel at a first location; and d) injecting liquid $CO_2$ from the phase separator into the flow channel downstream from the first location, wherein the liquid $CO_2$ changes to $CO_2$ snow for ejection through the exhaust nozzle toward the workpiece to be cleaned.

Accordingly, an object of the invention is to provide a method and apparatus for cleaning a workpiece with solid $CO_2$ particles, wherein pulsing is reduced by removing $CO_2$ vapor from the liquid $CO_2$ flow line.

The above object and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT

Figure 1:
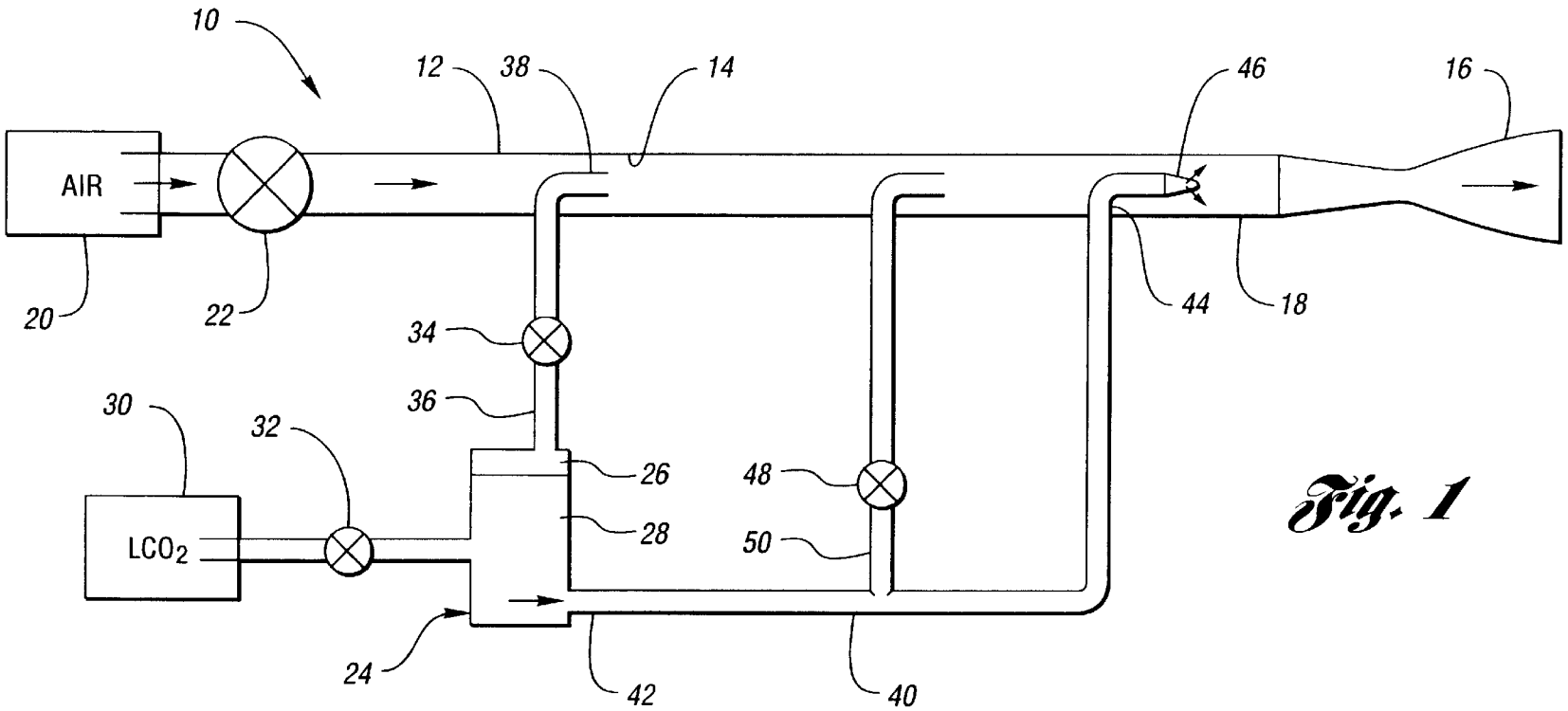
FIG. 1 shows a schematically arranged side view of a $CO_2$ snow cleaning system in accordance with the present invention.

Referring to FIG. 1, an apparatus 10 is shown for cleaning a workpiece with solid $CO_2$ particles in accordance with the present invention. The apparatus 10 includes a channel member 12 forming a flow channel 14 therein, and having an exhaust nozzle 16 at a distal end 18 thereof. A source of pressurized air 20 is provided in selective fluid communication with the flow channel 14. The air may be dried to a dew point of −40° F. to −100° F., and preheated by a trim heater up to about 300° F. An air on/off valve 22 is provided between the source of pressurized air 20 and the flow channel 14 for selectively communicating the air with the channel 14. The air on/off valve 22 preferably includes a manual valve and an electropneumatic, cryogenic on/off valve. Also, a pressure relief valve is provided.

A phase separator 24 includes first and second portions 26,28, respectively. A source of liquid $CO_2$ 30 is provided in selective fluid communication with the phase separator 24 via a liquid $CO_2$ on/off valve 32. The liquid $CO_2$ on/off valve preferably includes a cryogenic manual on/off valve and an electropneumatic cryogenic on/off valve. A pressure relief valve is also provided.

The phase separator 24 is operative to separate $CO_2$ vapor from the liquid $CO_2$ received from the liquid $CO_2$ source 30. The vapor migrates to the first portion 26 of the phase separator 24, and may be injected through the bleed line 34 and bleed valve 36 into the flow channel 14 at the outlet 38.

Liquid $CO_2$ remains within the second portion 28 of the phase separator 24.

A liquid flow line 40 is connected with the phase separator 24 and includes first and second ends 42,44, respectively. The first end 42 is in fluid communication with the second portion 28 of the phase separator 24 for directing liquid $CO_2$ to the injector nozzle 46 which is positioned at the second end 44 of the liquid flow line for injecting the liquid $CO_2$ into the flow channel 14. The injected liquid $CO_2$ then turns to $CO_2$ snow.

Accordingly, the phase separator 24 is operative to separate $CO_2$ vapor from the liquid $CO_2$ such that the vapor travels to the first portion 26 bleeding into the flow channel 14, and the liquid $CO_2$ remains in the second portion 28 for injection through the injector nozzle 46.

The phase separator 24 may comprise a commercial version called a Jo-Bell float valve, manufactured by Carbonic Industries Corporation of Atlanta, Ga. This device utilizes a magnetic switch actuated by a float. The automatic float valve maintains the liquid level as desired. The switch actuates a solenoid which vents any $CO_2$ vapor in the supply so that 100% liquid is available at the injector 46.

In another embodiment, the phase separator 24 comprises a trap having an upper part and a lower part 26,28, respectively. A bleed orifice is provided on top of the upper part, which allows the controlled bleed-off of the $CO_2$ vapor in the supply.

The apparatus 10 also includes a purge line 48 providing fluid communication between the liquid flow line 40 and the flow channel 14, and including a purge valve 50 therein for selectively purging $CO_2$ vapor from the liquid line 40. The purge line 48 is connected at one end to the flow channel 14 upstream from the exhaust nozzle 16, and at an opposite end to the liquid flow line 40 upstream from the injector nozzle 46. In this configuration, quick start up and shut down of the $CO_2$ supply may be achieved. During operation, flow of the $CO_2$ liquid is controlled by the size of the holes in the injector nozzle 46. Accordingly, the $CO_2$ bled-off in this fashion may be purged into the air line 14 upstream of the nozzle 16.

The electrical controls associated with the $CO_2$ snow generating system are responsible for the orderly start up and shut down of the $CO_2$ snow generating system operations. The $CO_2$ snow generating system can be operated in a stand-alone manual mode, or in an automatic mode (operated by a signal from an external programmable controller). In either manual or automatic mode, the function of the controls is identical. The controls are implemented using a combination of standard and programmable relays.

Figure 2:
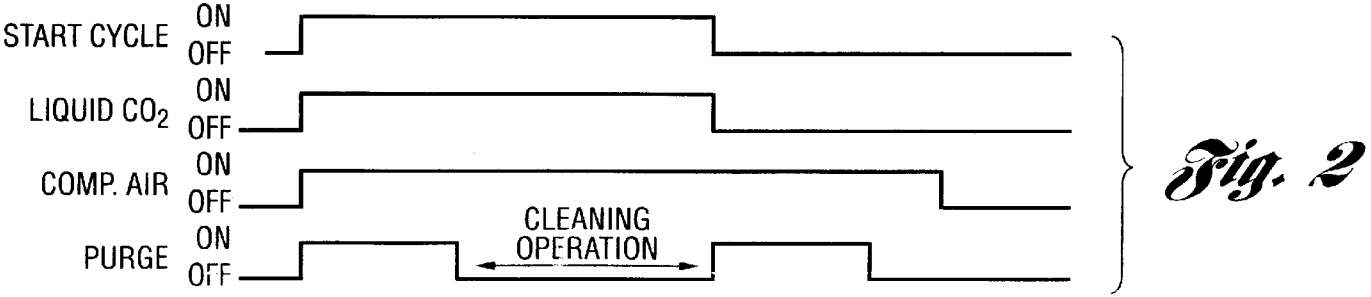
FIG. 2 shows a schematic cycle timing diagram in accordance with the present invention.

The controlled/sequenced operations of the system are as follows, as illustrated in FIG. 2:

A. A start cycle signal (originating from an external controller or manual switch closure) is activated.

B. The $CO_2$ relay opens the liquid $CO_2$ line. This line remains open until the start cycle signal is no longer present.

C. A "delay on brake" programmable relay opens the compressed air supply valve 22.

D. A timed interval relay opens the purge valve 50 for a pre-programmed time interval. This allows any trapped $CO_2$ gas that is present in the liquid $CO_2$ line 40 to be purged.

E. The purge valve 50 closes.

F. At this point, the system continues to operate with the compressed air and liquid $CO_2$ valves 22,32 open until the start cycle signal is no longer present.

G. The start cycle signal is turned off.

H. The timer of the "delay on brake" relay that controls the compressed air begins its pre-programmed delay. The compressed air remains on during this delay.

I. The $CO_2$ relay closes, stopping the flow of the liquid $CO_2$ through the valve 32.

J. The timed interval relay controlling the purge valve 50 opens. This allows any trapped liquid $CO_2$ to dissipate. The purge valve 50 remains open for the pre-programmed time interval.

K. The purge valve 50 closes.

L. The pre-programmed "delay on brake" relay times out and closes the compressed air supply valve 22.

While the best mode for carrying out the invention has been described in detail, those familiar with the art to which this invention relates will recognize various alternative designs and embodiments for practicing the invention within the scope of the appended claims.

What is claimed is:

1. An apparatus for cleaning a workpiece with solid $CO_2$ particles, comprising:

a channel member forming a flow channel having an exhaust nozzle at a distal end thereof;

a source of pressurized air in selective communication with the flow channel;

a phase separator having first and second portions, said first portion being in selective fluid communication with the flow channel;

a source of liquid $CO_2$ in selective fluid communication with the phase separator;

a liquid flow line having first and second ends, said first end being in fluid communication with said second portion of the phase separator, and said second end having an injector nozzle positioned within the flow channel;

wherein said phase separator is operative to separate $CO_2$ vapor from the liquid $CO_2$ such that the vapor travels to the first portion for selective fluid communication with the flow channel, and the liquid remains in the second portion for injection into the flow channel through the injector nozzle where it changes phase to $CO_2$ snow, and further through the exhaust nozzle for cleaning the workpiece.

2. The apparatus of claim 1, further comprising a purge line providing fluid communication between said liquid flow line and said flow channel and including a purge valve therein for selectively purging $CO_2$ vapor from the liquid line.

3. The apparatus of claim 2, wherein said purge line is connected to the flow channel upstream from the exhaust nozzle, and said purge line is connected to the liquid flow line upstream from said injector nozzle.

4. The apparatus of claim 1, further comprising a first electropneumatic, cryogenic on/off valve connected to said source of pressurized air and a second electropneumatic, cryogenic on/off valve connected to said source of liquid $CO_2$.

5. An apparatus for cleaning a workpiece with solid $CO_2$ particles, comprising:

a channel member forming a flow channel having an exhaust nozzle at a distal end thereof;

a source of pressurized air in selective fluid communication with said flow channel;

a phase separator in fluid communication with a source of liquid $CO_2$, said phase separator being operative to separate $CO_2$ vapor from the $CO_2$ liquid and operatively connected to the flow channel for directing said separated $CO_2$ vapor to the flow channel;

a liquid flow line connected to the phase separator for receiving liquid $CO_2$ and directing the liquid $CO_2$ to an injector nozzle positioned in the flow channel where it changes phase to $CO_2$ snow, and further through the exhaust nozzle for cleaning the workpiece.

6. The apparatus of claim 5, further comprising a purge line providing fluid communication between said liquid flow line and said flow channel and including a purge valve therein for selectively purging $CO_2$ vapor from the liquid line.

7. The apparatus of claim 6, wherein said purge line is connected to the flow channel upstream from the exhaust nozzle, and said purge line is connected to the liquid flow line upstream from said injector nozzle.

8. A method of cleaning a workpiece with solid $CO_2$ particles, comprising:

forcing air through a flow channel having an exhaust nozzle at a distal end thereof;

introducing liquid $CO_2$ into a phase separator to separate $CO_2$ vapor from the liquid $CO_2$;

introducing said separated $CO_2$ vapor into the flow channel at a first location;

injecting liquid $CO_2$ from the phase separator into the flow channel downstream from said first location, wherein the liquid $CO_2$ changes to $CO_2$ snow for ejection through the exhaust nozzle toward the workpiece to be cleaned.

9. The method of claim 8, further comprising purging $CO_2$ vapor from said liquid flow into said flow channel by means of a purge valve.

* * * * *